US005170853A

United States Patent [19]

Mason et al.

[11] Patent Number: 5,170,853

[45] Date of Patent: Dec. 15, 1992

[54] PIPE WIPER ASSEMBLY FOR A WELL DRILLING UNIT

[76] Inventors: Ronald J. Mason, 2629 N.W. 24th, Newcastle, Okla. 73065; Steven B. Mason, Rte. 2, Box CW402, Tuttle, Okla. 73089

[21] Appl. No.: 699,760

[22] Filed: May 14, 1991

[51] Int. Cl.[5] ..... E21B 33/08

[52] U.S. Cl. ..... 175/84; 166/84

[58] Field of Search ..... 166/82, 84; 175/84

[56] References Cited

U.S. PATENT DOCUMENTS

| | | | |
|---|---|---|---|
| 670,900 | 3/1901 | Kenney | 166/84 |
| 772,804 | 10/1904 | Hooper | 166/84 |
| 4,099,562 | 7/1978 | Mattoon | 166/84 |
| 4,345,766 | 8/1982 | Turanyi | 166/84 X |
| 4,399,869 | 8/1983 | Bentley | 175/84 X |
| 4,406,331 | 9/1983 | Bentley | 175/84 |
| 4,690,213 | 9/1987 | Stannard et al. | 166/84 |
| 4,889,184 | 12/1989 | Lugtmeier et al. | 166/84 X |

*Primary Examiner*—Hoang C. Dang

*Attorney, Agent, or Firm*—Glen M. Burdick; Bill D. McCarthy

[57] ABSTRACT

A pipe wiper assembly is provided which comprises a first housing for supportingly receiving at least one resilient wiper member, and a second housing supported above the well bore for connecting the first housing to the stack assembly of the drilling unit. The first and second housings are interconnected such that the first housing is selectively movable in response to vertical deviations of the drill pipe as the drill pipe is withdrawn from the vertically extending well bore.

16 Claims, 3 Drawing Sheets

PIPE WIPER ASSEMBLY FOR A WELL DRILLING UNIT

BACKGROUND OF THE INVENTION

1. Field of the Invention

The present invention relates generally to a well drilling unit employed in prospecting for gaseous and liquid minerals, and more particularly but not by limitation, to and improved pipe wiper assembly for a well drilling unit.

2. Description of Prior Art

Well drilling units are employed in prospecting for gaseous and liquid minerals and for bringing them to the surface. Because of the need for drilling to greater depths, as well as improving the speed of the drilling operation, traditional precision drilling techniques have been superseded by continuous rotary drilling. Rotary drilling utilizes rotational motion of a bit to drill the well bore. The bit is attached to a drill string which is comprised of drill collars, drill pipe and a kelly joint. At the surface, rotational motion is imparted on the drill string by a rotary table to which the kelly joint is attached.

The drill cuttings produced by the bit operating at the bottom of the well bore are carried to the earth's surface by circulating drilling fluids, i.e. drilling mud. That is, the drilling fluids are continuously pumped down the well bore through the kelly joint, the drill pipe and the bit and recirculated to the surface.

As drilling progresses, new joints of drill pipe are added. This process is commonly known in the art as "making a connection". Conversely, the drill string must also be removed periodically to replace worn bits and damaged drill pipe. This process in commonly known in the art as "tripping out". Tripping out is performed by removing two to four joints of drill pipe at a time, depending upon the size of the derrick of the well drilling unit.

A consequence of tripping out is spillage of drilling fluids because as the drill pipe is removed from the well bore drilling fluids drain from the inside and outside of the drill pipe. The spillage results in drilling fluids being wasted and rig workers being exposed to unsafe working conditions.

To prevent fluid drainage from the drill pipe during tripping out, pipe wipers have herefore been utilized to wipe the outside surface of the drill pipe as the drill pipe is hoisted out of the well bore. However, when employing the housing assemblies of the prior art to support the pipe wipers problems have been encountered in that the drilling fluids are not uniformly removed from the outside surface of the drill pipe. For example, when the shims are removed from the rotary table in order to allow tripping out of the drill pipe the drill pipe can vertically move or sway which results in uneven wiping of the external surface of the drill pipe, as well as causing excessive wear on the pipe wipers.

Thus, a need has long existed for an improved fluid wiper assembly which could compensate for vertical deviations of the drill pipe during tripping out (and thereby enhance removal of the drill fluids from the external surface of the drill pipe), as well as improve the life of the pipe wipers. It is to such an improved fluid wiper assembly that the present invention is directed.

SUMMARY OF THE INVENTION

The present invention relates to a fluid wiper assembly for a well drilling unit having a stack assembly sealingly mounted over a well bore through which a length of drill pipe is disposed. In one aspect the present invention relates to a fluid wiper housing assembly which comprises a first housing for supportingly receiving at least one pipe wiper member, and a second housing supported above the well bore for connecting the first housing to the stack assembly of the drilling unit. The first and second housings are interconnected such that the first housing is selectively movable in response to vertical deviations of the drill pipe as the drill pipe is withdrawn from the vertically extending well bore. Thus, the pipe wiper members supported within the first housing substantially uniformly frictionally engage the outer surface of the drill pipe during tripping out which enhances the removal of fluids from the drill pipe, as well as improving the useful life of the pipe wiper members.

The first housing, which defines a wiper holding chamber, is provided with a cover assembly which is selectively movable between a first position and a second position. In the first position the cover assembly closes off a peripheral portion of the wiper holding chamber so as to form a wiper retaining lip about an upper end of the first housing; whereas, in the second position the cover assembly is laterally displaced relative to the upper end of the first housing so as to provide substantially unrestricted access to the wiper holding chamber.

An object of the present invention is to provide an improved pipe wiper assembly housing for uses with a well drilling unit.

Another object of the present invention, while achieving the before stated object, is to provide an improved pipe wiper assembly which permits conventional pipe wipers to be selectively movable in response to vertical deviation of drill pipe as the drill pipe is withdrawn from the well bore during tripping out.

Another object of the invention, while achieving the before stated objects, is to provide an improved pipe wiper housing assembly adapted to support pipe wipers so that the pipe wipers are maintained in substantially uniform frictional engagement with the external surface of the drill pipe to enhance removal of fluids therefrom a the drill pipe is removed from the well bore during tripping out.

Still another object of the present invention, while achieving the before stated objects, is to provide an improved pipe wiper assembly which is economical to manufacture, durable in construction, and which permits one to more easily replace the pipe wipers during a drilling operation.

Other objects, features and advantages of the present invention will become apparent from the following detailed description when read in conjunction with the drawings and appended claims.

BRIEF DESCRIPTION OF THE DRAWINGS

FIG. 6 is a perspective view depicting an upper end portion of the upper housing of the pipe wiper assembly of the present invention wherein a cover assembly is in a retracted position.

DETAILED DESCRIPTION

Figure 1:
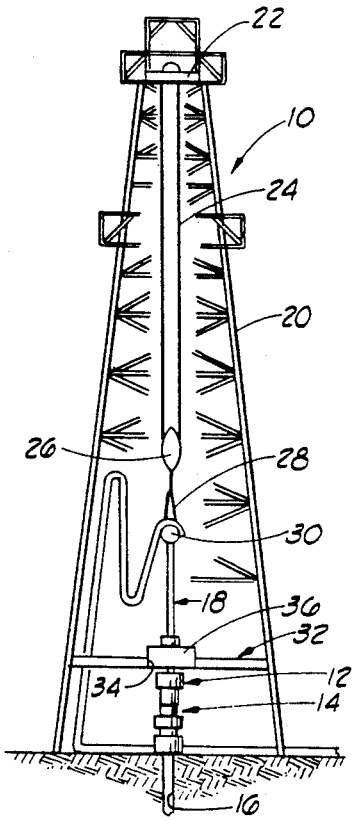
FIG. 1 is a schematic illustration of a rotary drilling unit utilizing a pipe wiper assembly constructed in accordance with the present invention.

Referring now to the drawings, and more particularly to FIG. 1, shown therein is a schematic illustration of a conventional well drilling unit, such as a rotary drilling unit 10, having a pipe wiper assembly 12 of the present invention connected to a stack assembly 14. The stack assembly 14 is sealingly mounted over a well bore 16 in a conventional manner. A length of drill pipe 18 having a bit (not shown) is disposed within the well bore 16 and extends upwardly through the stack assembly 14 and the pipe wiper assembly 12.

The rotary drilling unit 10 includes a derrick 20 of sufficient height so that the vertical clearance is sufficient to raise and lower the drill pipe 18 into and out of the well bore 16 during the drilling operation. The rotary drilling unit 10 is illustrated as further comprising a crown block 22, a drilling line 24, a traveling block 26, a rotary hook 28 and a swivel 30.

The derrick 20 is provided with a floor structure 32 having a centrally disposed opening 34 through which the drill pipe 18 extends; and the drill pipe 18 is supported in the opening 34 by a rotary table 36 capable of imparting rotary movement to the drill pipe 18. The rotary table 36 is operably connected to an engine (not shown) in a conventional manner such that upon actuation of the engine rotary movement is imparted to the rotary table 36 and thus to the drill pipe 18 during the drilling operation.

The rotary drilling unit 10, as well as the components thereof, are well known in the art. Thus, no further description of the rotary drilling unit 10 is believed necessary in order to enable one skilled in the art to understand the improved pipe wiper assembly 12 of the present invention, or the relationship of the pipe wiper assembly 12, the drill pipe 18 and other components of the rotary drilling unit 10 or any other well drilling unit on which the pipe wiper assembly 12 may be used.

As previously set forth, during the drilling operation employing a well drilling unit such as the rotary drilling unit 10, drill cuttings produced by the bit operating at the bottom of the well bore 16 are carried to the earth's surface by circulating drilling fluids, i.e. drilling mud. The drilling fluids are continuously pumped down the well bore 16 via a kelly joint (not shown) of the rotary drilling unit 10, the drill pipe 18 and the bit (also not shown) and recirculated to the surface.

During the drilling operation the drill pipe 18 must be periodically removed from the well bore 16 to replace worn bits and damaged drill pipe 18. When tripping out the drill pipe 18 shims (not shown) employed to stabilize the drill pipe 18 in the rotary table 36 are removed so that the drill pipe 18 can be hoisted and removed from the well bore 16. When the shims are removed the opening in the rotary table 36 is somewhat greater than the outside diameter of the drill pipe 18, including couplings therefore. Thus, the drill pipe 18 has a tendency to wobble or vertically deviate during the tripping out of the drill pipe 18.

During tripping out of the drill pipe 18 spillage of drilling fluids often occurs because of the adherence of the drilling fluids to the exterior surface of the drill pipe 18. Such spillage is undesirable not only from a waste stand point, but also because such spillage results in fluid deposits under the derrick 20, as well as on the floor structure 32 of the derrick 20, and thus provides unsafe working conditions. The pipe wiper assembly 12 of the present invention substantially eliminates spillage of such drilling fluids during the tripping out of the drill pipe 18 because of its unique design wherein a portion of the pipe wiper assembly 12 is selectively movable in response to vertical deviation of the drill pipe 18 as the drill pipe 18 is withdrawn from the vertically extending well bore 16. Thus the pipe wiper assembly 12 permits wiper members 38 (see FIG. 4) of the pipe wiper assembly 12 to be maintained in substantially uniform frictional engagement with an external surface of the drill pipe 18 so as to enhance removal of the drilling fluids therefrom.

The wiper members 38 are formed of resilient material and have a centrally disposed bore through which the drill pipe 18 is passed. The wiper members 38 are commercially available items heretofore used in the drilling of a well. Thus, no further comment concerning the construction or use of such wiper members 38 is believed necessary.

Referring now to FIGS. 2–6, the pipe wiper assembly 12 comprises a first or upper housing assembly 40 and a second or lower housing assembly 42. The second housing assembly 42 is connected to the stack assembly 14, such as via a rotating blowout preventer 44 (FIG. 4), by a conventional clamp 45 or other suitable means so that the second housing assembly 42 is supported above the well bore 16 in a stable, stationary position, and in fluid communication with the stack assembly 14.

Figure 4:
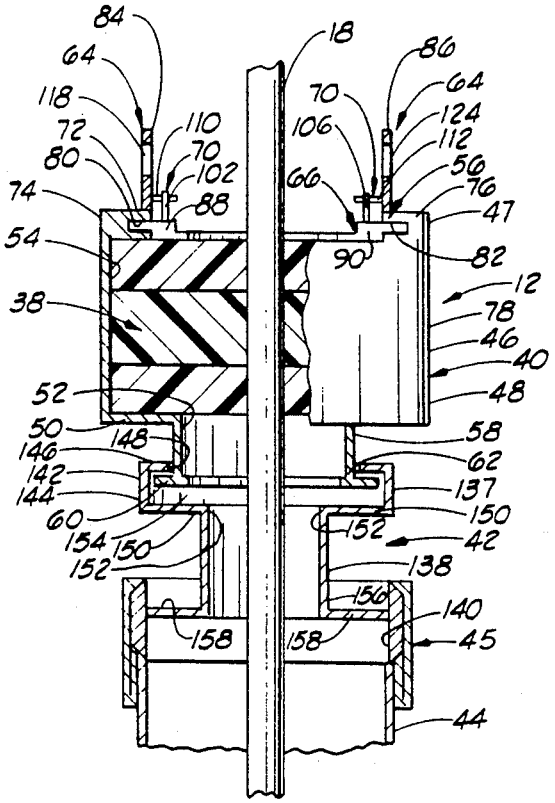
FIG. 4 is a cross sectional view of the pipe wiper assembly of the present invention having a drill pipe extending therethrough and illustrating the lower housing secured to a stack assembly of the rotary drilling unit.
Figure 3:
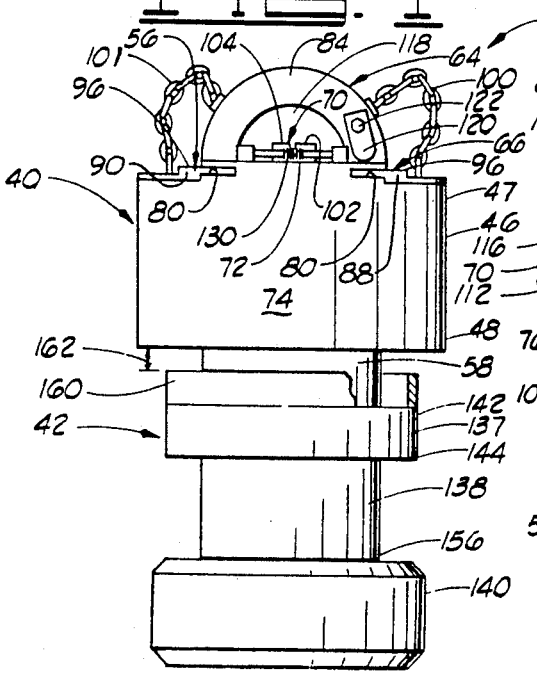
FIG. 3 is a perspective view of the pipe wiper assembly of the present invention wherein the upper housing is vertically deviated from alignment with the lower housing.

The first housing assembly 40, which contains the wiper members 38, is connected to the second housing assembly 42 so that the first housing assembly 40 is selectively movable in response to vertical deviation of the drill pipe 18 as the drill pipe 18 is withdrawn from the well bore 16 (FIG. 3). Thus, the interconnection of the first and second housing assemblies 40, 42 insures that the wiper members 38 supported within the first housing assembly 40 are maintained in substantially uniform frictional engagement with the external surface of the drill pipe 18 (substantially as shown in FIG. 4) as the drill pipe 18 is tripped out of the well bore 16, which enhances removal of drilling fluids therefrom and substantially eliminates spillage of the drilling fluids under the derrick 20, as well as on the floor structure 32 thereof.

The upper housing assembly 40 of the pipe wiper assembly 12 comprises a cylindrically shaped wiper housing 46 having an upper end 47 and an opposed lower end 48. A bottom plate 50 having a centrally disposed bore 52 therein is secured to the lower end 48 of the wiper housing 46 such that the wiper housing 46 defines a wiper holding chamber 54 therein adapted to supportingly receive the wiper members 38 substantially as shown in FIG. 4.

A wiper retainer assembly 56 is supported by the upper end 47 of the wiper housing 46 to insure that the wiper members 38 are retained within the wiper holding chamber 54 of the wiper housing 46 during retraction of the drill pipe 18 as a result of tripping out of the drill pipe 18.

A fluid passage conduit 58 having a retaining flange 60 (see FIG. 4) connected to a distal end 62 thereof is connected to the bottom plate 50 so as to be substantially centrally disposed relative to the wiper holding chamber 54 of the wiper housing 46. Thus, fluid communication is provided between the wiper holding chamber 54 and the fluid passage conduit 58. The retaining flange 60 is operably connected to the second housing assembly 42 (as will be discussed in detail hereinafter) so that the wiper housing 46 can vertically deviate relative to the second housing assembly 42 in response to vertical deviations of the drill pipe 18 as same is tripped out of the well bore 16.

The wiper retainer assembly 56 comprises a handle assembly 64 connected to the upper end 47 of the wiper housing 46, a cover assembly 66 slidably connectable to the handle assembly 64 and forming a wiper retaining lip 68 about the upper end 47 of the wiper housing 46, and a lock assembly 70 for securing the cover assembly 66 to the handle assembly 64. The handle assembly 64 comprises a first handle support member 72 secured to the upper end 47 of the wiper housing 46 so as to be disposed along one side 74 thereof; and a second handle support member 76 secured to the upper end 47 of the wiper housing 46 so as to be disposed along a second side 78 thereof and in a facing relationship with the first handle support member 72. The first and second handle support members 72, 76 cooperate with the upper end 47 of the wiper housing 46 to define first and second grooves 80, 82 which are adapted to slidingly receive the cover assembly 66.

The handle assembly 64 further comprises a first, arcuate-shaped handle member 84 and a second arcuate-shaped handle member 86. The first handle member 84 is connected to the first handle support member 72 so as to extend upwardly therefrom; and the second handle member 86 is connected to the second handle support member 76 so as to extend upwardly therefrom.

As previously stated, the cover assembly 66 is slidably disposed within the first and second grooves 80, 82 so as to be slidably movable between a first position and a second position. In the first position, the cover assembly 66 selectively closes off a peripheral portion of the wiper holding chamber 54 of the wiper housing 46 by forming the wiper retaining lip 68 (FIGS. 2–5); whereas, in the second position the cover assembly 66 is laterally displaced relative to the first and second handle support members 72, 76 of the handle assembly 64 (and thus the wiper holding chamber 54 of the wiper housing 46) to provide substantially unrestricted access to the wiper holding chamber 54 (FIG. 6).

Figure 2:
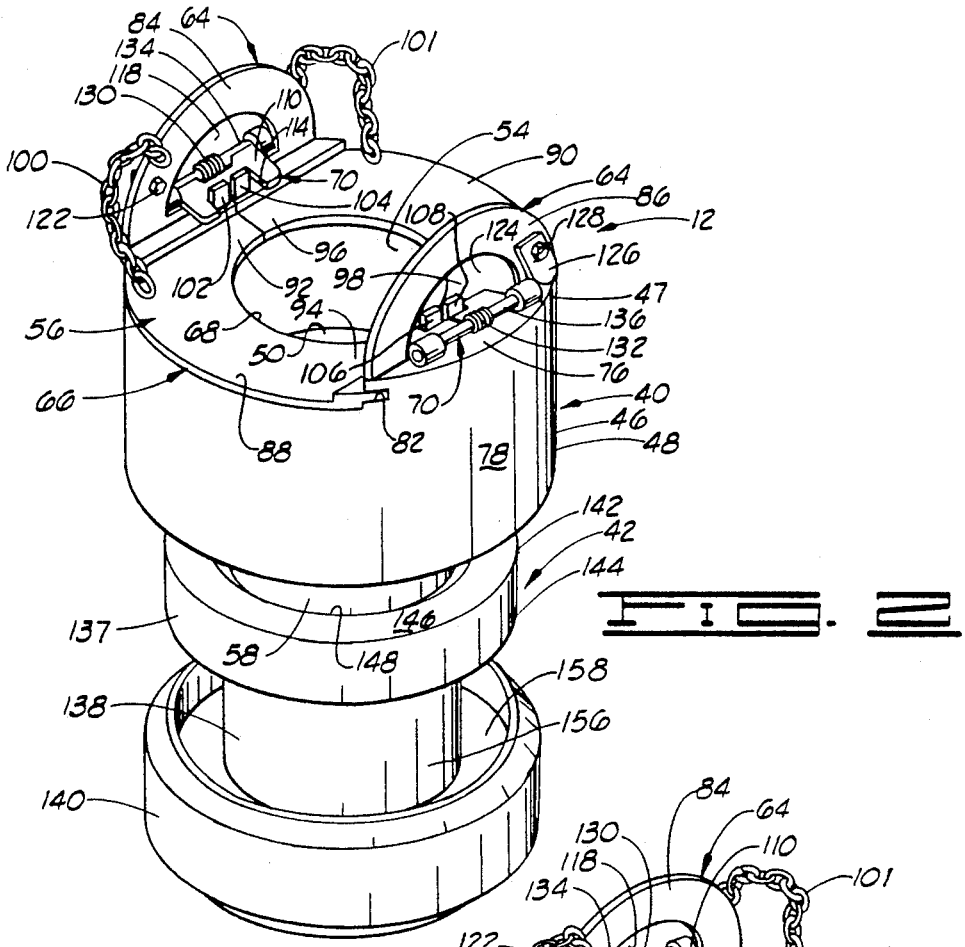
FIG. 2 is a perspective view of the pipe wiper assembly of the present invention wherein a lower and upper housing thereof are vertically aligned.
Figure 3:
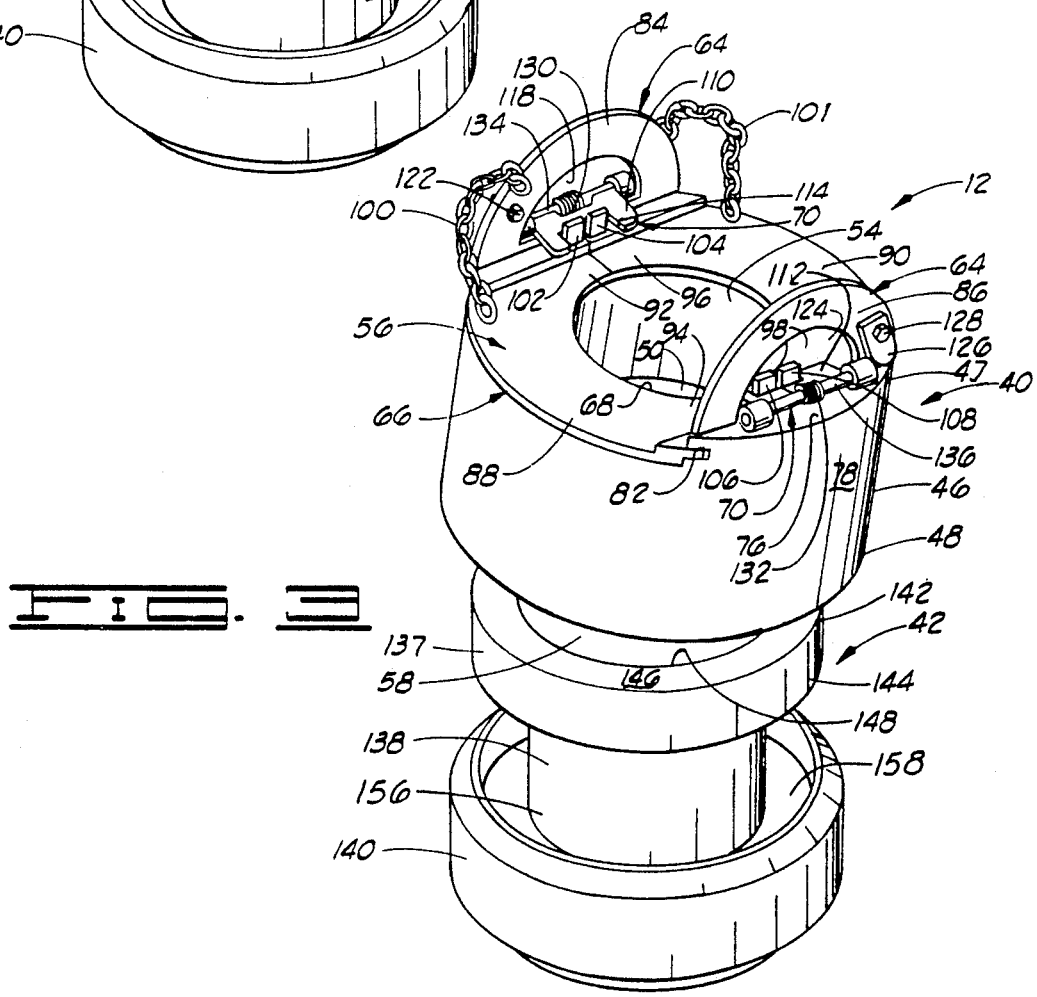

Referring more specifically to FIGS. 2, 3 and 6 the cover assembly 66 comprises a first substantially arcuate-shaped cover member 88 and a second substantially arcuate-shaped cover member 90. The first substantially arcuate-shaped cover member 88 is characterized as having a first end portion 92 and a second end portion 94. Similarly, the second substantially arcuate-shaped cover member 90 is characterized as having a first end portion 96 and a second end portion 98. The first end portions 92, 96 of the first and second substantially arcuate-shaped cover members 88, 90 are positionable within the first groove 80 in the wiper housing 46 (FIGS. 4 and 5); whereas the second end portions 94, 98 of the first and second substantially arcuate-shaped cover members 88, 90 are positionable within the second groove 82 in the wiper housing 46. Thus, when the first end portions 92, 96 of the first and second substantially arcuate-shaped cover members 88, 90 are supported within the first groove 80 so as to be disposed substantially adjacent each other, and the second end portions 94, 98 of the first and second substantially arcuate-shaped cover members 88, 90 are supported within the second groove 82, the first and second arcuate-shaped cover members 88, 90 cooperate to define the wiper retaining lip 68 about the upper end 47 of the wiper housing 46 substantially as shown in FIGS. 2 and 3.

In order to secure the first and second substantially arcuate-shaped cover members 88, 90 to the wiper housing 46 of the pipe wiper assembly 12 (when such cover members 88, 90 are selectively moved to the second position to provide unrestricted access to the wiper holding chamber 54), the pipe wiper assembly 12 further comprises a first chain member 100 for connecting the first end portion 92 of the first substantially arcuate-shaped cover member 88 to the first handle member 84, and a second chain member 101 for connecting the first end portion 96 of the second substantially arcuate-shaped cover member 90 to the first handle member 84 substantially as shown. Thus, the first and second chain members 100, 101 prevent disengagement of the first and second substantially arcuate-shaped members 88, 90 from the wiper housing 46 when the first and second substantially arcuate-shaped cover members 88, 90 are selectively moved to the second position.

Referring now to FIGS. 2, 3, 7 and 8, the lock assembly 70 for securing the first and second substantially arcuate-shaped cover members 88, 90 in the first position is more clearly shown. The lock assembly 70 comprises a plurality of upwardly extending leg members 102, 104, 106 and 108, a first tongue member 110 and a second tongue member 112. The first tongue member 110 is pivotally connected to the first handle support member 72 so as to be selectively movable between a first or locking position and a second or unlocked position; and the second tongue member 112 is pivotally connected to the second handle support member 76 so as to be selectively movable between a first or locked position and a second or unlocked position.

The first tongue member 110 is a substantially U-shaped member defining a centrally disposed recessed portion 114 substantially as shown. Similarly, the second tongue member 112 is a substantially U-shaped member defining a centrally disposed recessed portion 116 substantially as shown.

The leg members 102, 104 are connected to the first end portions 92, 96 of the first and second substantially arcuate-shaped cover members 88, 90 so as to extend upwardly therefrom and in close proximity to the first handle support member 72 when the first and second substantially arcuate-shaped cover members 88, 90 are disposed in the first position. Similarly, the upwardly extending leg members 106, 108 are connected to the second end portions 94, 98 of the first and second substantially arcuate-shaped cover members 88, 90 so as to extend upwardly therefrom and in close proximity to the second handle support member 76 when the first and second substantially arcuate-shaped cover members 88, 90 are disposed in the first position.

The upwardly extending leg members 102, 104 are positioned on the first end portions 92, 96 of the first and second substantially arcuate-shaped cover members 88, 90 so as to be aligned with each other when the first and second substantially arcuate-shaped cover members 88, 90 are supported within the first groove 80 defined by the first handle support member 72 and the upper end 47 of the wiper housing 46. Similarly, the upwardly extending leg members 106, 108 are positioned on the second end portions 94, 96 of the first and second substantially arcuate-shaped cover members 88, 90 so as to be aligned with each other when the second end portions 94, 96 of the first and second substantially arcuate-shaped cover members 88, 90 are disposed within the second groove 82 formed between the second handle support member 76 and the upper end 47 of the wiper housing 46.

Figure 7:
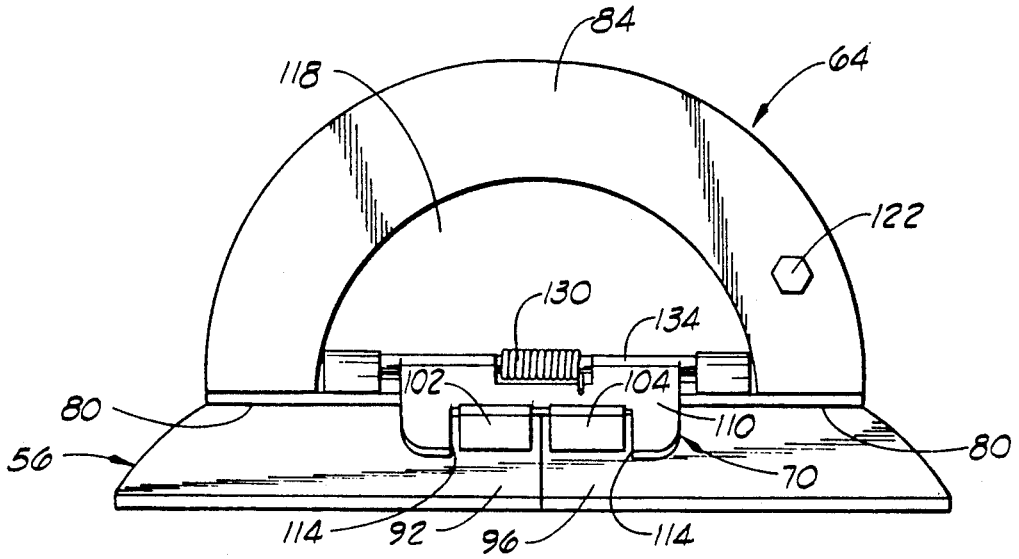
FIG. 7 is a fragmental view of a lock assembly of the pipe wiper assembly of the present invention, the lock assembly depicted in a locking position for securing the cover assembly to the upper housing of the pipe wiper assembly.
Figure 8:
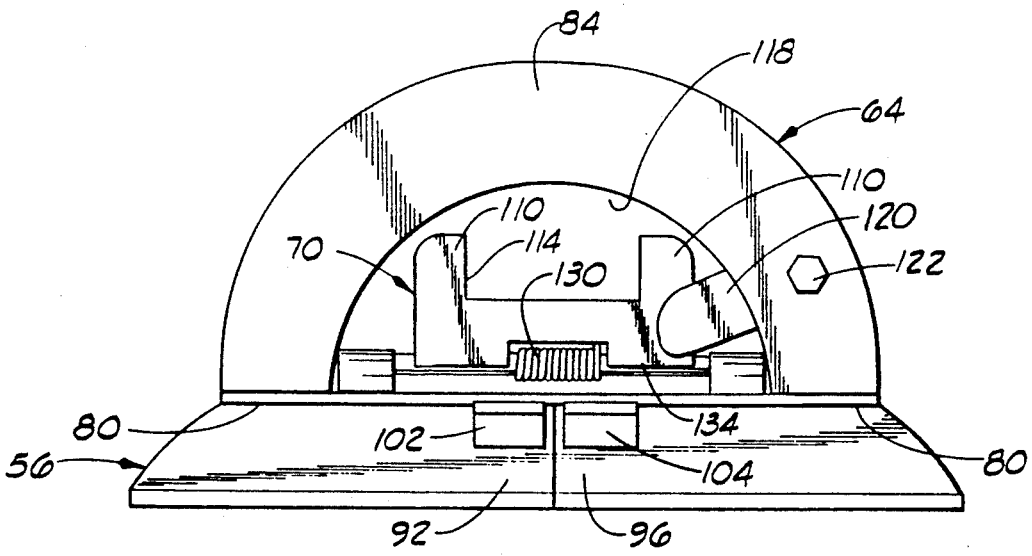
FIG. 8 is a fragmental view of the lock assembly of the pipe wiper assembly of the present invention, the lock assembly depicted in an unlocked position to permit removal of the cover assembly from the upper housing of the pipe wiper assembly.

The first handle member 84 is an arcuate-shaped member which defines an opening 118 between the first handle member 84 and the first handle support member 72. The first tongue member 110 is pivotally connected to the first handle support member 72 so as to be selectively movable through the opening 118 such that the first tongue member 110 can be disposed in either the first portion (FIG. 7) or the second position (FIG. 8). In the first position the first tongue member 110 engages the upwardly extending leg members 102, 104 on the first end portions 92, 96 of the first and second substantially arcuate-shaped cover members 88, 90 when the cover members 88 and 90 are supported within the first groove 80 and disposed substantially adjacent one another; whereas, in the second position the first tongue member 110 is pivoted upwardly to disengage the upwardly extending leg members 102, 104.

To stabilize the first tongue member 110 in the second position, a tab member 120 is pivotally connected to the first handle member 84 via a pivot bolt 122. Thus, to stabilize the first tongue member 110 in the second position the first tongue member 110 is pivoted upwardly through the opening 118 in the first handle member 84 and the tab member 120 is selectively moved so as to extend into the opening 118 and engages the first tongue member 110 substantially as shown in FIG. 8. When it is desired to release the first tongue member 110 so that the first tongue member 110 can again be disposed in the first position for engagement with the upwardly extending leg members 102, 104, the tab member 120 is withdrawn from the opening 118 so that the first tongue member 110 is free to pass through the opening 118 and into locking engagement with the upwardly extending leg members 102, 104 substantially as shown in FIG. 7.

The second handle member 86 is also an arcuate-shaped member and defines an opening 124 between the second handle member 86 and the second handle support member 76. The second tongue member 112 is pivotally connected to the second handle support member 76 so as to be selectively movable through the opening 124 such that the second tongue member 112 can be disposed in either the first position or the second position. In the first position the second tongue member 112 engages the upwardly extending leg members 106, 108 on the second end portions 94, 98 of the first and second substantially arcuate-shaped cover members 88, 90 when such cover members 88, 90 are supported within the second groove 82 and disposed substantially adjacent one another; whereas, in the second position the second tongue member 112 is pivoted upwardly to disengage the upwardly extending leg members 106, 108.

To stabilize the second tongue member 112 in the second position, a tab member 126 is pivotally connected to the second handle member 86 via a pivot bolt 128. Thus, to stabilize the second tongue member 112 in the second position the second tongue member 112 is pivoted upwardly through the opening 124 in the second handle member 86 and the tab member 126 is selectively moved so as to extend into the opening 124 and engage the second tongue member 112 in an identical manner as the tab member 120 engages the first tongue member 110 when the first tongue member 110 is secured in the second position. When it is desired to release the second tongue member 112 so that the second tongue member 112 can again be disposed in the first position for engagement with the upwardly extending leg members 106, 108, the tab member 126 is withdrawn from the opening 124 so that the second tongue member 112 is free to pass through the opening 124 and into locking engagement with the upwardly extending leg members 106, 108 substantially as shown in FIGS. 2 and 3.

In order to maintain the first and second tongue members 110, 112 in the first position, the lock assembly 70 further comprises a first biasing spring 130 and a second biasing spring 132. The first biasing spring 130 is connected to a base portion 134 of the first tongue member 110 in a conventional manner so that the first tongue member 110 is biased in its first position. Similarly, the second biasing spring 132 is connected to a base portion 136 of the second tongue member 112 so that the second tongue member 112 is biased in the first position. The interconnection of the first biasing spring 130 to the first tongue member 110, and the second biasing spring 132 to the second tongue member 112, is conventional. Thus, no further comments concerning the biasing of the first and second tongue members 110, 112 in the first position by the biasing springs 130, 132 is believed necessary to enable one skilled in the art to understand the inventive concept disclosed herein.

As previously stated, the first or upper housing assembly 40 of the pipe wiper assembly 12 is connected to the second or lower housing assembly 42 via the retaining flange 60 connected to the distal end 62 of the fluid passage conduit 58 so that the first housing assembly 40 is selectively movable in response to vertical deviations of the drill pipe 18 as the drill pipe 18 is withdrawn from the well bore 16.

Referring now to FIGS. 2–5, the second or lower housing assembly 42 comprises a substantially cylindrically shaped coupling housing 137, a fluid passage conduit 138 and a connector member 140 for connecting the lower housing assembly 42 to the stack assembly 14 such that fluid communication is established between the lower housing assembly 42 and the stack assembly 14. As previously stated, any suitable means can be employed to secure the connector member 140 to the stack assembly 14 in a stable, stationary position, such as with the clamp 46 (FIG. 4) or other suitable means.

The coupling housing 137 is characterized as having an upper end portion 142 and a lower end portion 144. An upper plate or lip member 146 having a centrally disposed bore 148 is connected to the upper end portion 142 of the coupling housing 137; and a bottom plate 150 having a centrally disposed bore 152 is connected to the lower end portion 144 of the coupling housing 137. Thus, the lip member 146 and the bottom plate 150 cooperate with the coupling housing 137 to define a coupling chamber 154 adapted to receive the retaining flange 60 and a portion of the fluid passage conduit 58 of the upper housing assembly 40.

In order to secure the retaining flange 60 of the upper housing assembly 40 within the coupling chamber 154, the bore 148 in the lip member 146 and the bore 152 in the bottom plate 150 each have diameter greater the outside diameter of the fluid passage conduit 58 of the upper housing assembly 40, but less than the diameter of the retaining flange 60 attached to the distal end portion 62 of the fluid passage conduit 58. Thus, the lip member 146 and the bottom plate 150 cooperate to secure the retaining flange 60, and thus the distal end 62 of the fluid passage conuit 58 of the first housing assembly 40, within the coupling chamber 154 of the coupling housing 137 substantially as shown. Further, it should be noted that the coupling chamber 154 of the coupling housing 137 is provided with a sufficient depth to permit the desired vertical movement of the upper housing assembly 40 with respect to the lower housing assembly 42 so as to permit the upper housing assembly 40, and thus the wiper members 38 supported therein, to be vertically displaced to correspond to vertical deviations of the drill pipe 18 when the drill pipe 18 is tripped out of the well bore 16.

The fluid passage conduit 138 is connected to the bottom plate 150 so that fluid communication is established therebetween; and the connector member 140 is connected to a distal end 156 of the fluid passage conduit 138. The configuration of the connector member 140 can vary and will depend upon the configuration of the portion of the stack assembly 14 to which the lower housing assembly 42 is to be connected. Further, the connector member 140 can be connected to the distal end 156 of the fluid passage conduit 138 by any suitable means, such as connector plate 158.

During the tripping out of the drill pipe 18 from the well bore 16 joints or coupling between segments of the drill pipe 18 must also pass through the wiper housing 46 and the wiper members 38 supported therein. Because of the increased diameter of such joints the upper housing assembly 40 may be momentarily displaced a small distance in the direction of the lower housing assembly 42 which may result in a "splashing" of any fluids present in the coupling chamber 154 of the coupling housing 137.

Figure 5:
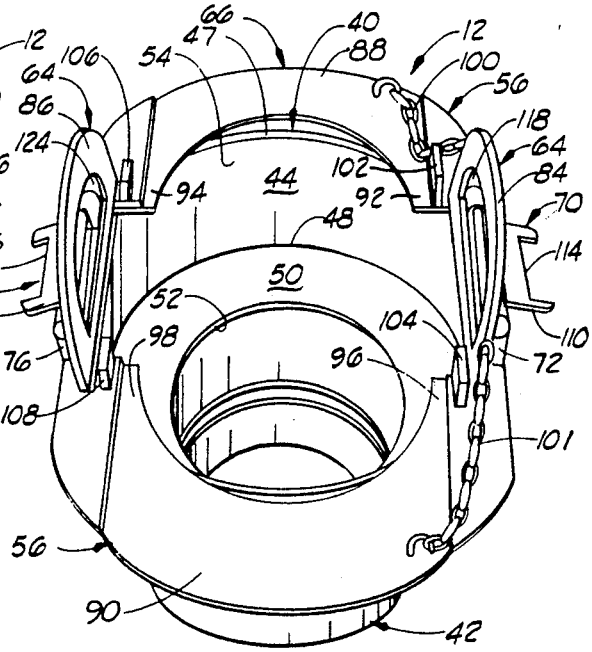
FIG. 5 is a partially cutaway, side elevational view of the pipe wiper assembly of the present invention having a splash shield connected to the lower housing.

Referring now to FIG. 5, the second or lower housing assembly 42 is illustrated as having a splash shield 160 supported on the upper plate or lip member 146 of the second housing assembly 42. The splash shield 160, an annular member, extends upwardly from the lip member 146 and terminates a distance 162 from lower end 48 of the wiper housing 46. The distance 162 between the splash shield 160 and the lower end 48 of the wiper housing 46 substantially corresponds to the depth of the coupling chamber 154 in the coupling housing 137. Thus, the splash shield 160 does not interfere with the desired vertical movement of the first or upper housing assembly 40 relative to the second or lower housing assembly 42 during tripping out of the drill pipe 18 from the well bore 16.

The unique design of the pipe wiper assembly 12 clearly overcomes the disadvantages of the pipe wiper assemblies of the prior art in that the pipe wiper assembly 112 permits conventional pipe wipers to maintain substantially uniform frictional engagement with the external surface of the drill pipe 18, thus enhancing removal of drilling fluids from the external surface of the drill pipe 18 during tripping out of the drill pipe 18.

It will be clear that the present invention is well adapted to carry out the objects and attain the advantages mentioned as well as those inherent therein. While a presently preferred embodiment of the invention has been described for purposes of this disclosure, numerous changes can be made which will readily suggest themselves to those skilled in the art and which are encompassed within the spirit of the invention disclosed and as defined in the appended claims.

What is claimed is:

1. A pipe wiper assembly for a well drilling unit in which a length of drill pipe is disposed in a vertically extending well bore in the earth, the drilling unit having a stack assembly sealingly mounted over the well bore, the pipe wiper assembly comprising:

first housing means for wiping fluid from the drill pipe as the drill pipe is retracted from the well bore, the first housing means comprising:

a wipe housing having an upper end, a lower end and wiper holding chamber extending therebetween;

at least one resilient wiper member supported within the wiper holding chamber, the resilient wiper member having a drill pipe receiving bore through which the drill pipe travels as the drill pipe is retracted from the well bore;

a wiper retainer means supported by the upper end of the wiper housing for retaining the resilient wiper member in the wiper holding chamber, the wiper retainer means comprising:

handle means connected to opposed sides of the wiper housing, the handle means defining a first groove and a second groove, the first groove disposed along a portion of the upper end of the wiper housing and the second groove disposed along an opposed portion of the upper end of the wiper housing such that the first and second grooves are in a facing relationship;

cover means slidably disposed within the first and second grooves for forming a wiper retaining lip about the upper end of the wiper housing so that the resilient wiper member is secured in the wiper holding chamber as force is exerted on the resilient wiper member when the drill pipe is withdrawn from the vertically extending well bore, the cover means selectively movable to a retracted position wherein the cover means is laterally displaced relative to the handle means and the wiper holding chamber of the wiper housing so as to provide substantially unrestricted access to the wiper holding chamber; and lock means for securing the cover means to the wiper housing;

a first fluid passage conduit connected to the lower end of the wiper housing, the first fluid passage conduit centrally disposed relative to the wiper holding chamber of the wiper housing so that fluid communication is provided therebetween; and a retaining flange connected to a distal end of the first fluid passage conduit;

second housing means supported above the well bore for connecting the retaining flange of the first fluid passage conduit to the stack assembly such that fluid communication is established between the wiper housing member of the first housing means and the stack assembly, the retaining flange operably connected to the second housing means so that the wiper housing and the first fluid passage conduit of the first housing means are selectively movable relative to the second housing means in response to vertical deviation of the vertically extending drill pipe as the drill pipe is withdrawn from the vertically extending well bore so that the resilient wiper member supported within the wiper holding chamber of the wiper housing of the first housing means maintains substantially uniform frictional engagement with the external surface of the drill pipe and enhances removal of fluids therefrom, the second housing means comprising:

a coupling housing having an upper end portion, a lower end portion and a fluid flow passageway extending therebetween, the upper end portion defining a coupling chamber adapted to receive the retaining flange of the fluid passage conduit of the first housing means;

lip means connected to a peripheral portion of the upper end portion of the housing for retaining the retaining flange of the first housing means within the coupling chamber, the lip means defining a bore having a diameter greater than the outside diameter of the first fluid passage conduit and less than the diameter of the retaining flange of the first housing means;

a second fluid passage conduit connected to the lower end of the coupling housing so that fluid communication is provided between the coupling chamber in the coupling housing and the second fluid passage conduit of the second housing means, the second fluid passage conduit having a distal end; and connecting means for connecting the distal end of the second fluid passage conduit to the fluid stack assembly.

2. The pipe wiper assembly of claim 1 wherein the handle means comprises:

a first handle support member secured to the upper end of the wiper housing so as to be disposed along a portion of side thereof, the first handle support member defining the first groove;

a first arcuate-shaped handle member connected to the first handle support member so as to extend upwardly therefrom;

a second handle support member secured to the upper end of the wiper housing along a second side portion thereof so as to be disposed in a facing relationship with the first handle support member, the second handle support member defining the second groove; and a second arcuate-shaped handle member connected to the second handle support member so as to extend upwardly therefrom.

3. The pipe wiper assembly of claim 2 wherein the cover means comprises:

a first substantially arcuate-shaped cover member having a first end portion and a second end portion; and a second substantially arcuate-shaped cover member having a first end portion and a second end portion, the first end portions of the first and second substantially arcuate-shaped cover members positionable within the first groove and the second end portions of the first and second substantially arcuate-shaped cover members positionable within the second groove so that the first and second substantially arcuate-shaped cover members cooperate to form the wiper retaining lip about the upper end of the wiper housing.

4. The pipe wiper assembly of claim 3 wherein the lock means comprises:

a plurality of upwardly extending leg members, one of the leg member connected to the first and second end portions of each of the first and second cover members, the upwardly extending leg members connected to the first end portions of the first and second cover members being alignable with each other when the first and second cover members are supported within the first groove and the first end portions of the first and second cover members are substantially adjacently disposed, the upwardly extending leg members connected to the second end portions of the first and second cover members being alignable with each other when the first and second cover members are supported within the second groove and the second end portions of the first and second cover members are substantially adjacently disposed;

a first tongue member pivotally connected to the first handle support member so as to be selectively movable between a first position and a second position, in the first position the first tongue member engaging the upwardly extending leg members on the first end portions of the first and second cover members when the first end portion of the first and second cover members are supported within the first groove and disposed substantially adjacent one another, in the second position the first tongue member pivoted upwardly and away from engaging contact with the upwardly extending leg members on the first end portions of the first and second cover members; and a second tongue member pivotally connected to the second handle support member and selectively movable between a first position and a second position, in the first position the second tongue member engaging the upwardly extending leg members on the second end portion of the first and second cover members when the second end portions of the first and second cover members are positioned within the second groove and disposed substantially adjacent one another, in the second position the second tongue member pivoted upwardly and away from engaging contact with the upwardly extending leg members on the second end portions of the first and second cover member.

5. The fluid wiper assembly of claim 4 wherein the lock means further comprises:

first biasing means for biasing the first tongue member in the first position; and second biasing means for biasing the second tongue member in the first position.

6. The pipe wiper assembly of claim 4 further comprising:

chain means for connecting the first handle member to the first end portions of the first and second substantially arcuate-shaped cover members to secure the first and second substantially arcuate-shaped cover members to the first handle member.

7. The pipe wiper assembly of claim 4 further comprising:

an annular shield member supported on the upper end portion of the coupling housing of the second housing means.

8. A pipe wiper assembly for a drilling unit in which a length of pipe is disposed in a vertically extending well bore in the earth, the drilling unit having a stack assembly sealingly mounted over the well bore, the pipe wiper housing assembly adapted to support at least one resilient wiper member in a stable position so as to frictionally engage the drill pipe and remove fluids therefrom, the pipe wiper housing assembly comprising:

first housing means for supportingly receiving the pipe wiper member, the first housing means comprising:

a wiper housing having an upper end, a lower end and a wiper holding chamber extending therebetween;

wiper retainer means supported by the upper end of the wiper housing for retaining the wiper member in the wiper holding chamber, the wiper retainer means comprising:

handle means connected to opposed sides of the wiper housing, the handle means defining a first groove and a second groove, the first groove disposed along a first portion of the upper end of the wiper housing and the second groove disposed along a second portion of the upper end of the wiper housing such that the first and second grooves are oppositely disposed and in a facing relationship;

cover means disposed within the first and second grooves and selectively movable between a first position and a second position, in the first position the cover means selectively closing off a peripheral portion of the wiper holding chamber in the wiper housing so as to form a wiper restraining lip about the upper end to the wiper housing, in the second position the cover means laterally displaced relative to the handle means and the wiper holding chamber of the wiper housing to provide substantially unrestricted access to the wiper holding chamber; and lock means for securing the cover means in the first position to the wiper housing;

a wiper housing fluid passage conduit connected to the lower end of the wiper housing so as to extend therefrom, the wiper housing fluid passage conduit centrally disposed relative the wiper holding chamber of the wiper housing so that fluid communication is provided therebetween; and flange means connected to a distal end of the wiper housing fluid passage conduit;

second housing means supported above the well bore for connecting the retaining flange of the wiper housing fluid passage conduit to the stack assembly such that fluid communication is established between the wiper housing member of the first housing means and the stack assembly, the retaining flange operably connected to the second housing means so that the wiper housing and the wiper housing fluid passage conduit are selectively movable relative to the second housing means in response to vertical deviation of the vertically extending drill pipe as the drill pipe is with drawn from the vertically extending well bore so that the resilient wiper member supported within the wiper holding chamber of the wiper housing of the first housing means maintains substantially uniform frictional engagement with the external surface of the drill pipe and enhances removal of fluids therefrom, the second housing means comprising:

a coupling housing having an upper end, a lower end and a fluid flow passageway extending therebetween, the coupling housing defining a coupling chamber adapted to receive the flange means;

a restraining lip connected to a peripheral portion of the upper end of the coupling housing for closing off a portion of the coupling chamber and thereby securing the flange means of the first housing means within the coupling chamber;

a bottom plate connected to the lower end of the coupling housing, the bottom plate having a centrally disposed bore therein;

a fluid passage conduit connected to the bottom plate of the coupling housing, the fluid passage conduit having a distal end; and means for connecting the distal end of the fluid passage conduit of the coupling housing to the stack assembly such that a fluid-tight connection is formed therebetween and the coupling housing and fluid passage conduit of the second housing means are secured in a stable position relative to the stack assembly.

9. A pipe wiper housing assembly for a drilling unit in which a length of pipe is disposed in a vertically extending well bore int he earth, the drilling unit having a stack assembly sealing mounted over the well bore, the pipe wiper housing assembly adapted to support at least one resilient wiper member in a stable position so as to frictionally engage the drill pipe and remove fluids therefrom, the pipe wiper housing assembly comprising:

first housing means for supportingly receiving the pipe wiper member, the first housing means comprising:

a wiper housing having an upper end, a lower end and a wiper holding chamber extending therebetween;

wiper retainer means supported by the upper end of the wiper housing for retaining the wiper member in the wiper holding chamber, the wiper retainer means comprising:

handle means connected to opposed sides of the wiper housing, the handle means defining a first groove and a second groove, the first groove disposed along a portion of the upper end of the wiper housing and the second groove disposed along an opposed portion of the upper end of the wiper housing such that the first and second grooves are in a facing relationship;

cover means slidably disposed within the first and second grooves for forming a wiper retaining lip about the upper end of the wiper housing defining the wiper housing chamber so that the resilient wiper member is secured in the wiper holding chamber as force is exerted on the resilient wiper member when the drill pipe is withdrawn from the vertically extending earth bore, the cover means selectively movable to a retracted position wherein the cover means is laterally displaced relative to the handle means and the wiper holding chamber of the wiper housing so as to provide substantially unrestricted access to the wiper holding chamber; and lock means for securing the cover means to the wiper housing;

a wiper housing fluid passage conduit connected to the lower end of the wiper housing so as to extend therefrom, the wiper housing fluid passage conduit centrally disposed relative to the wiper holding chamber of the wiper housing so that fluid communication is provided therebetween; and flange means connected to a distal end of the wiper housing fluid passage conduit; and second housing means supported above the well bore and adapted to receive the flange means for connecting the wiper housing and the wiper housing fluid passage conduit of the first housing means to the stack assembly so that the wiper housing and wiper housing fluid passage conduit are selectively movable relative to the second housing means in response to vertical deviation of the vertically extending drill pipe as the drill pipe is withdrawn from the vertically extending well bore and thereby provide substantially uniform frictional engagement between the outer surface of the drill pipe and the pipe wiper member supported within the wiper housing to enhance removal of fluids from the drill pipe.

10. The pipe wiper assembly of claim 1 wherein the handle means comprises:

a first handle support member secured to the upper end of the wiper housing so as to be disposed along a portion of one side thereof, the first handle support member defining the first groove;

a first arcuate-shaped handle member connected to the first handle support member so as to extend upwardly therefrom;

a second handle support member secured to the upper end of the wiper housing so as to be disposed along a portion of a second side portion thereof and in a facing relationship with the first handle support member, the second handle support member defining the second groove; and a second arcuate-shaped handle member connected to the second handle support member so as to extend upwardly therefrom.

11. The pipe wiper assembly of claim 10 wherein the cover means comprises:

a first substantially arcuate-shaped cover member having a first end portion and a second end portion; and a second substantially arcuate-shaped cover member having a first end portion and a second end portion, the first end portions of the first and second substantially arcuate-shaped cover members positionable within the first groove and the second end portions of the first and second substantially arcuate-shaped cover members positionable within the second groove defined by the so that the first and second substantially arcuate-shaped cover members cooperate to form the wiper retaining lip about the upper end of the wiper housing.

12. The pipe wiper assembly of claim 11 wherein the lock means comprises:

a plurality of upwardly extending leg members, one of the leg member connected to the first and second end portions of each of the first and second cover members, the upwardly extending leg members connected to the first end portions of the first and second cover members being alignable with each other when the first and second cover members are supported within the first groove and the first end portions of the first and second cover members are substantially adjacently disposed, the upwardly extending leg members connected to the second end portions of the first and second cover members being alignable with each other when the first and second cover members are supported within the second groove and the second end portions of the first and second cover members are substantially adjacently disposed;

a first tongue member pivotally connected to the first handle support member so as to be selectively movable between a first position and a second position, in the first position the first tongue member engaging the upwardly extending leg members on the first end portions of the first and second cover members when the first end portion of the first and second cover members are supported within the first groove and disposed substantially adjacent one another, in the second position the first tongue member being pivoted upwardly and away from engaging contact with the upwardly extending leg members on the first end portions of the first and second cover members; and a second tongue member pivotally connected to the second handle support member and selectively movable between a first position and a second position, in the first position the second tongue member engaging the upwardly extending leg members on the second end portion of the first and second cover members when the second end portions of the first and second cover members are positioned within the second groove and disposed substantially adjacent one another, in the second position the second tongue member being pivoted upwardly and away from engaging contact with the upwardly extending leg members on the second end portions of the first and second cover member.

13. The pipe wiper assembly of claim 12 further comprising:

chain means for connecting the first handle member to the first end portions of the first and second substantially arcuate-shaped cover members to secure the first and second substantially arcuate-shaped cover members to the first handle member.

14. The pipe wiper assembly of claim 13 further comprising:

an annular shield supported on the upper end portion of the coupling housing of the second housing means.

15. The pipe wiper assembly of claim 14 wherein the lock means further comprises:

first biasing means for biasing the first tongue member in the first position: and second biasing means for biasing the second tongue member in the second position.

16. The pipe wiper assembly of claim 9 further comprising:

an annular shield supported on the second housing means so as to extend upwardly in the direction of the wiper housing of the first housing means, the annular shield member terminating a distance form the wiper housing so as to permit the wiper housing and the wiper housing fluid passage conduit to be selectively movable with relation to the second housing means in response to vertical deviation of the drill pipe.

* * * * *

UNITED STATES PATENT AND TRADEMARK OFFICE

CERTIFICATE OF CORRECTION

PATENT NO. : 5,170,853

DATED : December 15, 1992

INVENTOR(S) : Ronald J. Mason & Steven B. Mason

It is certified that error appears in the above-identified patent and that said Letters Patent is hereby corrected as shown below:

Column 2, line 48, delete "a the" and substitute therefor --as the-- as it appears on page 4, line 24 of the original application; and Column 14, line 46, delete "int he" and substitute therefor --in the-- as it appears on page 10, line 3 in an Amendment filed on May 26, 1992; and Column 15, lines 54-56, delete "end of wiper housing so as to be disposed along a portion of a second side portion thereof and in a facing relationship with the first handle support" and substitute therefor --end of the wiper housing along a second side portion thereof so as to be disposed in a facing relationship with the first handle support-- as it appears on page 27, lines 10-13 of the original application.

UNITED STATES PATENT AND TRADEMARK OFFICE

CERTIFICATE OF CORRECTION

PATENT NO. : 5,170,853

DATED : December 15, 1992

INVENTOR(S) : Ronald J. Mason, et al.

It is certified that error appears in the above-identified patent and that said Letters Patent is hereby corrected as shown below:

Column 16, line 56, delete "member" and substitute therefor --members--. The error appears on the first line appearing on page 30 of the application as filed.

Signed and Sealed this

Thirtieth Day of November, 1993

*Attest:*

*Attesting Officer*

BRUCE LEHMAN

*Commissioner of Patents and Trademarks*